United States Patent [19]

Overton et al.

[11] 4,041,895

[45] Aug. 16, 1977

[54] COATING THICKNESS AND DISTRIBUTION CONTROL

[75] Inventors: Harold C. Overton; Theodore L. Page, both of Gadsden, Ala.

[73] Assignee: Republic Steel Corporation, Cleveland, Ohio

[21] Appl. No.: 617,742

[22] Filed: Sept. 29, 1975

[51] Int. Cl.[2] ..... B05C 11/06

[52] U.S. Cl. ..... 118/7; 118/63; 118/419; 427/349

[58] Field of Search ..... 427/348, 349; 34/23, 34/24, 54, 160; 15/418, 419; 118/63, 7; 239/592, 593, 594

[56] References Cited

U.S. PATENT DOCUMENTS

| | | | |
|---|---|---|---|
| 2,242,182 | 5/1941 | McCann | 118/51 |
| 2,650,131 | 8/1953 | Spooner | 100/224 |
| 2,679,231 | 5/1954 | Pomper et al. | 118/63 |
| 2,685,146 | 8/1954 | Stevens | 43/56 |
| 2,766,720 | 10/1956 | Muller et al. | 118/63 |
| 3,264,673 | 8/1966 | Scott | 15/308 |
| 3,272,176 | 9/1966 | Saydlowski | 118/63 |
| 3,406,656 | 10/1968 | Patterson | 118/63 |
| 3,494,324 | 2/1970 | Bauer et al. | 118/63 X |
| 3,499,418 | 3/1970 | Mayhew | 118/63 X |
| 3,670,695 | 6/1972 | Patterson | 118/63 |
| 3,841,557 | 10/1974 | Atkinson | 118/63 X |
| 3,917,888 | 11/1975 | Beam et al. | 118/63 X |
| 3,938,468 | 2/1976 | Kirschner | 118/69 |

*Primary Examiner*—Mervin Stein

*Attorney, Agent, or Firm*—Watts, Hoffmann, Fisher & Heinke Co.

[57] ABSTRACT

A system for controlling the thickness and distribution of a coating applied to a moving substrate includes a pair of "air knives" which discharge pressurized fluid onto a moving substrate as it emerges from a coating bath to screed excess coating from the substrate and leave a coating deposit having a desired thickness and distribution. Each air knife has a plenum chamber which supplies pressurized fluid to a pair of nozzle lips that define an elongated nozzle opening. Fluid flow influencing devices are provided between the plenum and the nozzle lips of each air knife. The flow influencing devices preferably include a baffle plate, a screen assembly, a shutter plate, and a vane assembly. The baffle plate and the screen assembly help assure that a laminar, equally pressurized flow is supplied to the shutter plate. The shutter plate has specially configured flow restricting openings that cause the pressure profile of fluid discharging from the air knives to vary in a predetermined manner along the length of their nozzle openings, whereby coating profiles are caused to vary in a predetermined manner across the width of the substrate. The vane assembly includes vanes which help to control the directions of fluid discharge through the nozzle openings. Pressurized fluid is supplied to the air knives by a system which includes a blower, and blower speed is controlled in response to sensed line speed of the moving substrate to assure that a coating deposit of desired thickness remains on the substrate.

3 Claims, 17 Drawing Figures

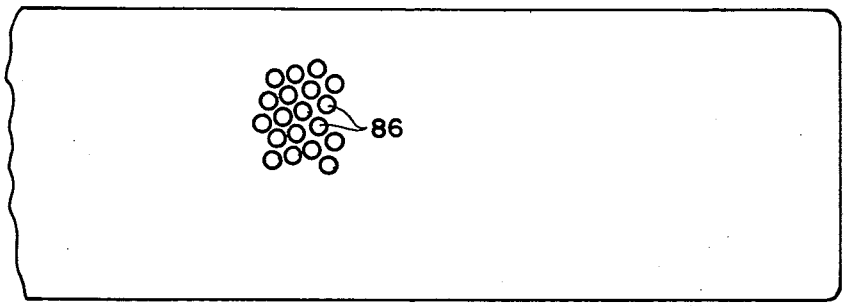
FIG. 6
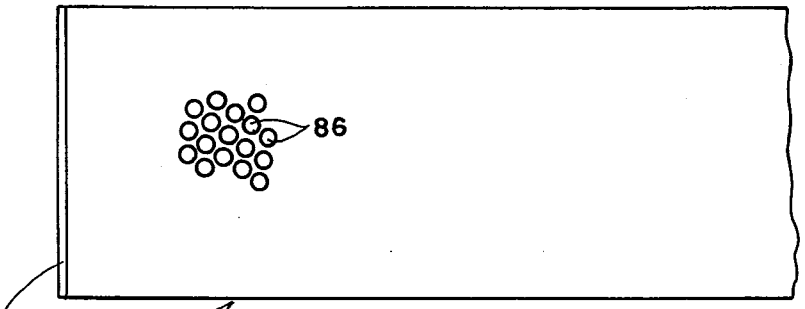
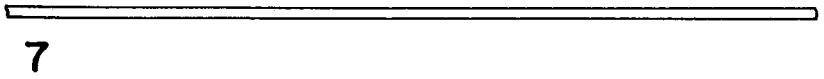
FIG. 7
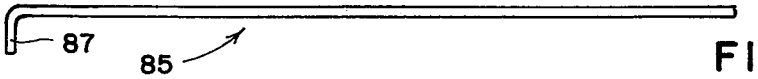
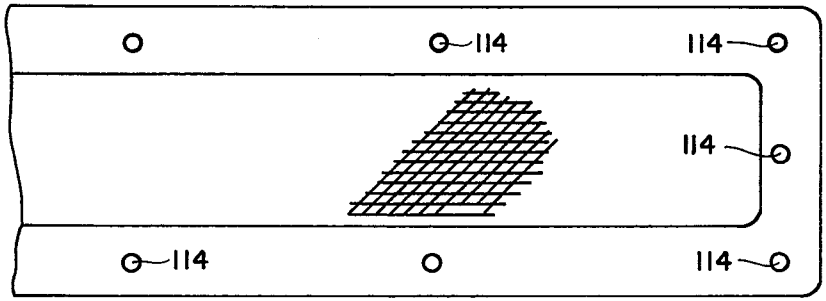
FIG. 8
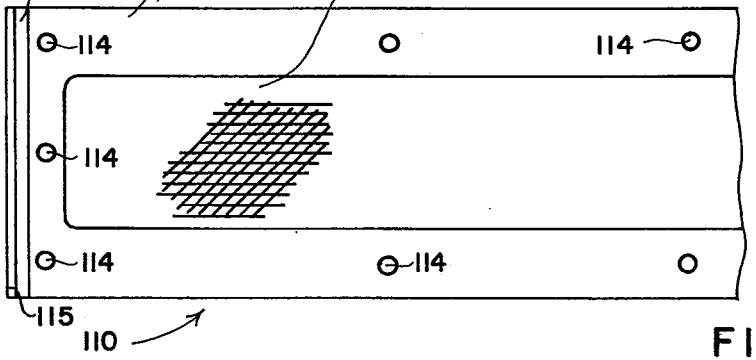
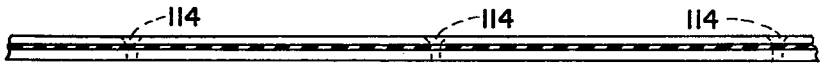
FIG. 9
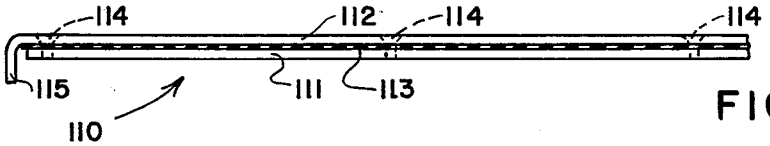

COATING THICKNESS AND DISTRIBUTION CONTROL

BACKGROUND OF THE INVENTION

1. Field of the Invention

The present invention relates generally to a system for controlling the thickness and distribution of a coating applied to a moving substrate. More particularly, the invention relates to novel and improved apparatus for controlling the thickness and distribution of zinc coating applied to a steel substrate in a "hot dip" galvanizing process.

2. Prior Art

In a "hot dip" coating process, a moving substrate such as steel is coated with a corrosion resistant material such as zinc by feeding the substrate through a coating bath. The substrate emerges from the bath along a generally vertical feed path with molten coating material deposited on its surfaces.

The profile of the coating deposited on the substrate must be controlled to assure a substantially uniform coating on the resulting product. Profile control is also important to prevent wasteful deposition of excessively thick coatings and to assure that the coated substrate will perform in a consistent and desired manner in such handling processes as coiling, stacking, and shipment, and in such fabrication processes as die forming and welding.

There are two aspects of profile control which require careful control. The first aspect is coating thickness which is expressed in the art as coating "weight." Coating thickness is specified in ounces per square foot when a coated product is ordered. The second aspect is coating distribution, which is often preferably nonuniform in cross-section across the width of a substrate. For example, distribution of coating with thinner coating thicknesses in marginal portions is often desirable.

The thickness of the coating deposited on the substrate as the substrate travels through and emerges from the coating bath is dependent on a number of factors including the line speed of the moving substrate. While most of the coating thickness determination factor can be held relatively constant to minimize their influence on coating thickness, line speed remains a variable. Line speed is preferably maintained at a relatively high velocity during the majority of a coating run, but must be significantly reduced from time to time to permit the welding of a new source of substrate to the depleting source of substrate being coated. When line speed decreases, the thickness of coating material removed from the coating bath by the moving substrate decreases correspondingly. When line speed increases, a corresponding increase in deposited coating results.

The distribution of coating deposited on a substrate as the substrate emerges from the coating bath ordinarily varies considerably from that which is desired. The uniformity of the deposited coating improves due to surface tension forces and the tendency of the coating to flow as the substrate moves upwardly along a path of travel from the coating bath.

Coating thickness and distribution can be modified after a coated substrate has emerged from the coating bath. Various coating control systems have been proposed for use near a coating bath to modify the profile of the coating deposited on a substrate. Proposed control systems have included such devices as rolls which engage the coated substrate, and fluid devices which do not engage the substrate but rather direct controlled flows of pressurized fluid toward the coated substrate.

A problem with proposed coating control systems has been their inability to maintain a predetermined coating profile during changes in line speed of the moving substrate. While some control systems have been proposed to assure that the amount of coating screeded from the substrate decreases with a line speed decrease and increases with a line speed increase, substantial variations in coating profile result during line speed changes.

Similar problems are encountered with proposed coating control devices in obtaining the same coating profile on substrates of different thicknesses. Relatively thick substrates are in many systems, run at lower line speeds than relative thin substrates because thicker substrates require greater coating bath immersion time to bring them to a proper temperature for coating deposit. While the same coating profile may be desired on both thick and thin substrates, these substrates may well be run at different ranges of line speeds. The coating control devices should, accordingly, not only be operable to maintain coating profile when line speed changes within a given range for a given substrate, but should also be operable to provide the same given coating profile within different line speed operating ranges. Proposed coating control systems have not provided this desired degree of versatility.

A further problem encountered in the coating of substrates is that some substrates require heavier or thicker coating applications than others. Where the substrate will be subjected to a highly corrosive environment, an application 2½ ounces or more of zinc coating per square foot is often sought. Other substrates may require an application of only 0.25 ounce or less of zinc per square foot. Controlling coating thickness accurately within such a wide range of operation has been difficult with prior coating control systems.

Still another problem encountered in the coating of substrates is that different coating distributions are preferred depending on the use which is to be made of the coated substrate. Proposed coating control devices have been difficult to adjust to obtain any substantial change in coating distribution.

Where the substrate being coated is to be coiled for storage and shipment, it is advantageous to provide a slightly convex distribution of coating on the substrate with the coating at its thickest near the center and progressively thinner further from the center. A convex coating surface mitigates the tendency of a substrate to "spool" during coiling and helps minimize damage which may result in peripheral regions due to stretching and deformation during coiling.

Where the substrate being coated is cut into relatively short lengths and stacked rather than being coiled a more nearly uniformly thick coating is desired. In order to permit the coating of coilable and cut-to-length substrates on the same processing line, it is desirable to provide a capability to alter distributions from uniform thickness to any of a range of desired convex configurations. Previously proposed coating control devices have not given this desired versatility.

While it would be desirable to provide a coating control system which can be set at the beginning of a coating run to provide a particular coating profile, proposed coating systems have not been sufficiently reliable in operation to provide the desired profile.

Accordingly, coating thickness and distribution is normally monitored in present-day practice by beta or gamma ray, back-scatter coating gauges.

These back-scatter gauges scan the width of a coated substrate and instantaneously provide data on coating thickness and distribution. The data from such gauges can be fed automatically to computer systems which operate the control devices to effect any needed correction in coating thickness and distribution. A problem with such systems is that the beta or gamma ray gauges are necessarily located as much as several hundred feet downstream from the coating control devices. Where such gauges are relied on as the primary source of data to operate the coating control devices, a substantial amount of improperly coated substrate can be produced before coating deficiencies are detected, compensations are made, and further data is received indicating what, if any, further corrections need be made. For this reason a substantial quantity of material may be wasted, especially at the beginning of a coating run.

Of the various types of proposed coating control devices, pressurized fluid-emitting devices have been found to most successfully control coating thickness and distribution. Pressurized fluid devices are preferred to rolls for a number of reasons including the fact that fluid control devices permit the use of higher line speeds, thinner coatings, and thinner gauge substrates than are possible with rolls. A smoother finish, free from marks and damage occasioned by the use of rolls, is attainable with fluid control devices.

A number of pressurized fluid mediums have been used in such devices with superheated steam and pressurized air being the most common. Pressurized air has been found to be preferably to steam for a number of reasons. These include:

a. Where steam is used, narrower nozzle openings are required. Any oxide scale that breaks loose in steam supply conduits can plug portions of the narrow nozzle openings, causing imperfections in coated substrate.
b. Steam nozzles are found to generate substantially higher noise levels than pressurized air nozzles.
c. The energy required to heat steam makes its use less economical than air.
d. The attendant corrosion of surrounding equipment and buildings encountered with the use of steam.

The nozzles used to direct pressurized fluids onto a coated substrate as it emerges from a coating bath are known in the art as "air knives." An air knife typically includes a pair of elongated lips which are spaced to define a narrow elongated discharge opening. A plenum chamber or "header" is provided upstream from the discharge opening and extends the full length of the discharge opening. A convergent throat or transition section is provided between the plenum chamber and the lips to duct pressurized fluid from the plenum chamber to the discharge opening. A pressure distribution device such as a small mesh screen is ordinarily used in the throat section to assure that a laminar flow of equally pressurized air is delivered to and discharged from all portions of the discharge opening.

Two oppositely oriented air knives are used to direct pressurized fluid toward both faces of a substrate shortly after it exits from a coating bath. The position of the air knives is critical to the successful control of coating thickness and distribution. Proper positioning for a particular substrate, coating material, line speed and desired coating profile is ascertained through careful experiementation. In general, the knives are positioned between about 8 to 30 inches above the surface of the coating bath with their longitudinal axes horizontal. They are also positioned to discharge fluid toward the generally vertical path of the substrate. The knife lips are usually spaced about ½ to 2½ inches from the moving substrate.

The knives may be inclined to discharge fluid upwardly or downwardly toward the substrate at angles between about 20° above horizontal to about 45° below horizontal. Angles of inclination of between about 10° above horizontal to about 30° below horizontal are found to be most useful, with angles of between about 5° to 15° below horizontal being preferred for galvanizing operatons.

Curved air knives, i.e., air knives having curved lips, have been proposed to achieve a convex coating profile. The radius of curvature for such knives is typically about 13 feet. Where the curvature of such knives extends in a vertical plane, the actual radii of curvature of the top and bottom knives differ slightly to achieve a uniform height orifice opening along the full length of the knife lips.

In operation, the curved air knives are positioned such that the distance between the substrate and the knife lips is greatest at the center of the knife lips. The variation in distance from the substrate which is achieved by the curvature of the knife facilitates the formation of a coating of convex cross-section on the substrate.

Curved air knives discharge fluid at pressures which are substantially uniform along the length of the nozzle lips. Since the fluid discharged from central portions of the nozzle lips must travel a greater distance to reach the coated substrate than fluid discharged from end regions of the nozzle lips, the centrally discharged fluid has a lesser pressure than does the end-discharged fluid when the fluid reaches the substrate. Curved air knives may therefore be said to utilize a differential in pressure between the center and the edges of a substrate to provide a convex coating profile on the substrate.

Since a curved air knife designed for use on wide substrates will not afford desired pressure differential when used on relatively narrow substrates, knife changes are necessary between production runs. One proposal for knife changing suggests knives of a variety of lengths mounted at circumferentially spaced locations about a rotatable turret. When substrate width is changed, the proper length air knife is rotated into operating position. The escape of pressurized fluid from air knives not in use is prevented by removing their pressure distribution screens and substituting impervious baffle plates.

While curved air knives have been found to operate satisfactorily in the production of convex coating profiles, these knives have a number of disadvantages. A significant drawback of curved air knives is their very expensive fabrication cost. Accurately machining a 13-foot radius of curvature along surfaces that extend for several feet is expensive. Moreover, the upper and lower lips and their associated mounting parts are not interchangeable and require different machining operations to fabricate. A single set of curved air knife lips, at present-day material and labor prices, is found to cost about $17,000.

Curved air knives are not easily adjusted for use with a wide range of substrates, coating materials, line speeds and desired coating profiles. Uniform coating distributions having no convexity or concavity in their profiles are almost impossible to achieve using curved air knives.

When the inclination of a curved knife is adjusted to accommodate a new substrate or coating material, the distance from the center of the curved knife lips to the substrate changes even through the distance from ends of the knife lips to the substrate may be held constant. To state this problem another way, adjustment in one knife setting influences adjustments in other knife settings to a far greater degree in curved knives than in straight knives, whereby some compromises in desired adjustment of curved knives are frequently required.

The supply of pressurized fluid to air knives has previously been regulated by adjustable louvers positioned in the intake of a blower to regulate the blower's output. Pressure transducers have been provided downstream from the blower to sense supply pressure. Tachometer sensors have been provided on one or more of the rolls which feed the substrate to sense line speed. Signals from the pressure transducers and from the tachometer sensors have been fed to a computer system which generates an output signal to open or close the blower intake louvers as required to maintain desired supply pressures at various line speeds. Such a system of transducers, sensors, and computer controlled louvers is complex and expensive to build, install and maintain.

SUMMARY OF THE INVENTION

The present invention overcomes the foregoing and other drawbacks of the prior art and provides a novel and improved coating control system. Coating control apparatus embodying the present invention is substantially less expensive to fabricate than previously proposed apparatus and can be adjusted with ease to accommodate a wide variety of coating profiles, coating thicknesses, coating materials, substrate materials, and substrate widths.

In the preferred practice of the present invention, a series of flow influencing devices are interposed between the plenum chamber and the nozzle lips of an air knife. These flow influencing devices operate together to provide a directionally controlled, laminar flow of fluid discharging from the nozzle lips and having a pressure profile that varies along the length of the lips in a predetermined manner to give a desired coating profile.

The flow influencing devices preferably include a perforated baffle plate, a screen assembly, a shutter plate, and a vane assembly. In preferred practice, the baffle plate and the screen assembly are positioned upstream from the shutter plate, and operate to provide a uniform pressure laminar flow of fluid to the shutter plate. The shutter plate is provided with one or more openings through which fluid must flow on its way toward the nozzle lips.

The shutter opening or openings vary in width along the length of the shutter plate and operate to restrict fluid flow at selected locations along the length of the nozzle lips. A shutter opening of hour-glass shape is used to diminish fluid discharge pressure at central locations along the length of the nozzle lips to provide a coating profile of convex cross-section. Shutter openings of other shapes are used to provide other pressure and coating profiles.

The vane assembly is positioned downstream from the shutter plate and includes a plurality of spaced vanes which duct fluid that has passed through the shutter openings toward the nozzle lips. In preferred practice, the vanes are arranged in two groups, with one group being located near one end of the nozzle lips and the other group located near the other end. In the best mode known to the inventor for practicing the present invention, the vanes in each group are curved to impart a small vector of longitudinal movement to the fluid which discharges from opposite end regions of the nozzle lips. The resulting directionally controlled flow helps to prevent the build-up of excess coating material along peripheral or edge portions of the substrate and thereby obviates "spooling" problems when the coated substrate is coiled.

Each air knife embodying the invention is provided with a removable end cover which permits ready access to all four of the flow influencing devices. Once the end cover is removed, any one of the devices can be removed for cleaning or replacement simply by pulling it out of positioning slots in the air knife assembly.

A significant feature of the invention is that changes can be made quickly and easily in coating profile simply by pulling shutter plates out of their positioning slots and replacing them with shutter plates having differently configured shutter openings.

Another significant feature of the present invention is that it permits uniform coating distributions or selected concave, convex, or otherwise contoured coating profiles to be produced using straight-lipped air knives. The expense in fabricating air knives is significantly reduced and improved coating profile versatility and ease of adjustment is obtained. The air knives used in the preferred practice of the present invention are found to cost less than 10 percent of the cost of previously used curved air knives.

An additional feature of the present invention is that it permits the use of the same relatively long air knives with various width substrates. The need for a plurality of different air knives for use with different width substrates is obviated.

While some "fine tuning" of the pressure profile may be effected by adjusting the gap between knife lips, the shutter system has been found to be sufficiently reliable to alleviate most fine tuning adjustments. Coating distribution profiles can be reliably and accurately changed simply by changing shutters.

Other advantages provided by the present invention are that the straight lips are easy to machine, are interchangeable, and require fewer and less complex mounting parts. The reduction in complexity of the air knife assemblies minimizes maintenance costs and down time.

In accordance with still another feature of the invention, coating thickness is controlled by controlling the static pressure supplied to air knives with a much simpler system than was previously thought possible. The costly pressure transducers, adjustable louvers, and computer controls used in prior air knife systems are eliminated and replaced by a simple blower motor speed control which adjusts blower speed in accordance with sensed line speed. A manual control is provided which is set by an operator at a setting representative of desired coating thickness. Once the manual control is set, the blower motor speed control will increase or decrease blower speed as is needed to maintain the desired thickness regardless of changes in line speed.

The overall cost reduction which can be achieved in the preferred practice of the present invention is quite dramatic. Previous installations have typically cost about 350,000 dollars, an installation of comparable equipment embodying the present invention can be made for approximately 160,000 dollars.

It is a general object of the present invention to provide novel and improved apparatus for controlling the deposit of coatings on a moving substrate.

Other objects and a fuller understanding of the invention may be had by referring to the following description and claims taken in conjunction with the accompanying drawings.

BRIEF DESCRIPTION OF THE DRAWINGS

FIG. 6 is an enlarged, foreshortened, side elevational view of a baffle used in either of the air knife embodiment of FIGS. 3 and 4;

FIG. 7 is a foreshortened, top plan view of the baffle of FIG. 6;

FIG. 8 is a foreshortened, side elevational view of a screen used in either of the air knife embodiments of FIGS. 3 and 4;

FIG. 9 is a foreshortened, top plan view of the screen of FIG. 8;

DESCRIPTION OF THE PREFERRED EMBODIMENT

Figure 1:
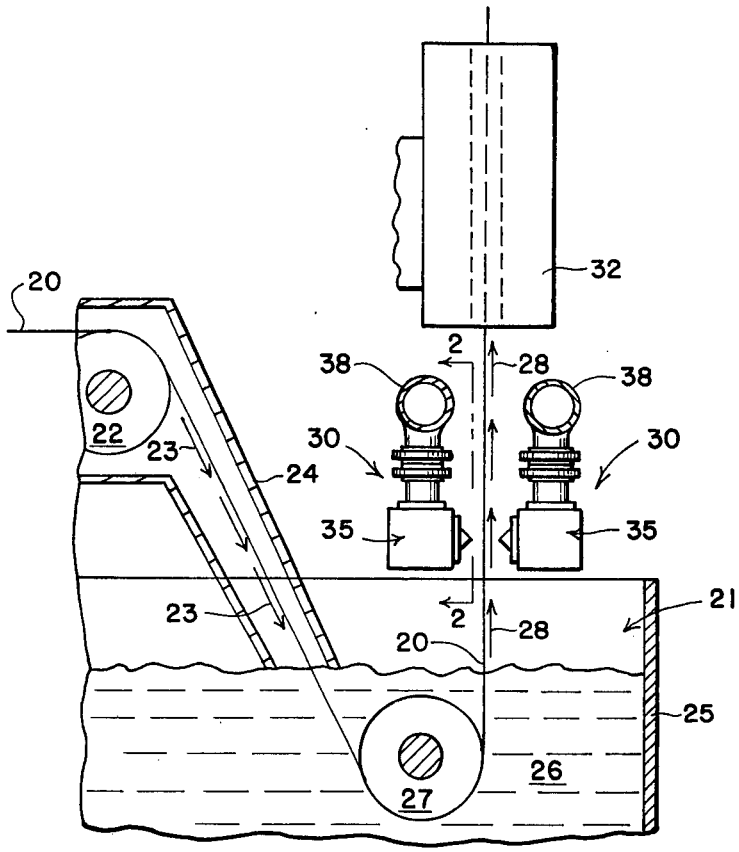
FIG. 1 is a schematic view of an apparatus including two air knives which embody certain aspects of the present invention.

Referring to FIG. 1, in the preferred practice of the present invention, a moving substrate 20 is coated by feeding it through a heated coating bath 21. As the substrate 20 exits from the coating bath 21, it carries molten coating material in excess of the desired final coating thickness. The excess coating is removed by a pair of coating control assemblies 30 which discharge pressurized fluid onto opposite sides of the substrate 20 to establish a desired coating thickness and distribution on the substrate. The coated substrate 20 subsequently enters a cooling apparatus 32 where its temperature is reduced below the melting point of the coating material to solidify the deposited coating.

Where the coating process is a conventional "hot dip" galvanizing process, the substrate is steel and the coating material is molten zinc. The steel substrate 20 is fed over a roll 22 as it exits from a conventional cleaning and/or annealing apparatus (not shown). The steel substrate 20 travels in a direction indicated by arrows 23 through a controlled atmosphere snout 24 and into a receptacle 25 containing molten zinc coating material 26. The steel substrate 20 is fed around a sink roll 27 journaled at a submerged position in the coating bath 21. From the sink roll 27, the steel substrate 20 travels upwardly and exits the coating bath 21 along a vertical feed path, as indicated by arrows 28.

The coating control assemblies 30 discharge pressurized fluid toward opposite sides of the moving substrate 20 to fluidically screed excess coating material off the substrate and to leave only such coating material as is required to provide a desired coating thickness and distribution. As will be explained, the pressure profiles of fluid discharging from the control assemblies 30 are controlled to provide a controlled screeding of coating. Any of a wide range of coating thicknesses and distributions can be established on the substrate 20 by controlling the pressure profiles of fluid discharged by the coating control assemblies 30.

Figure 2:
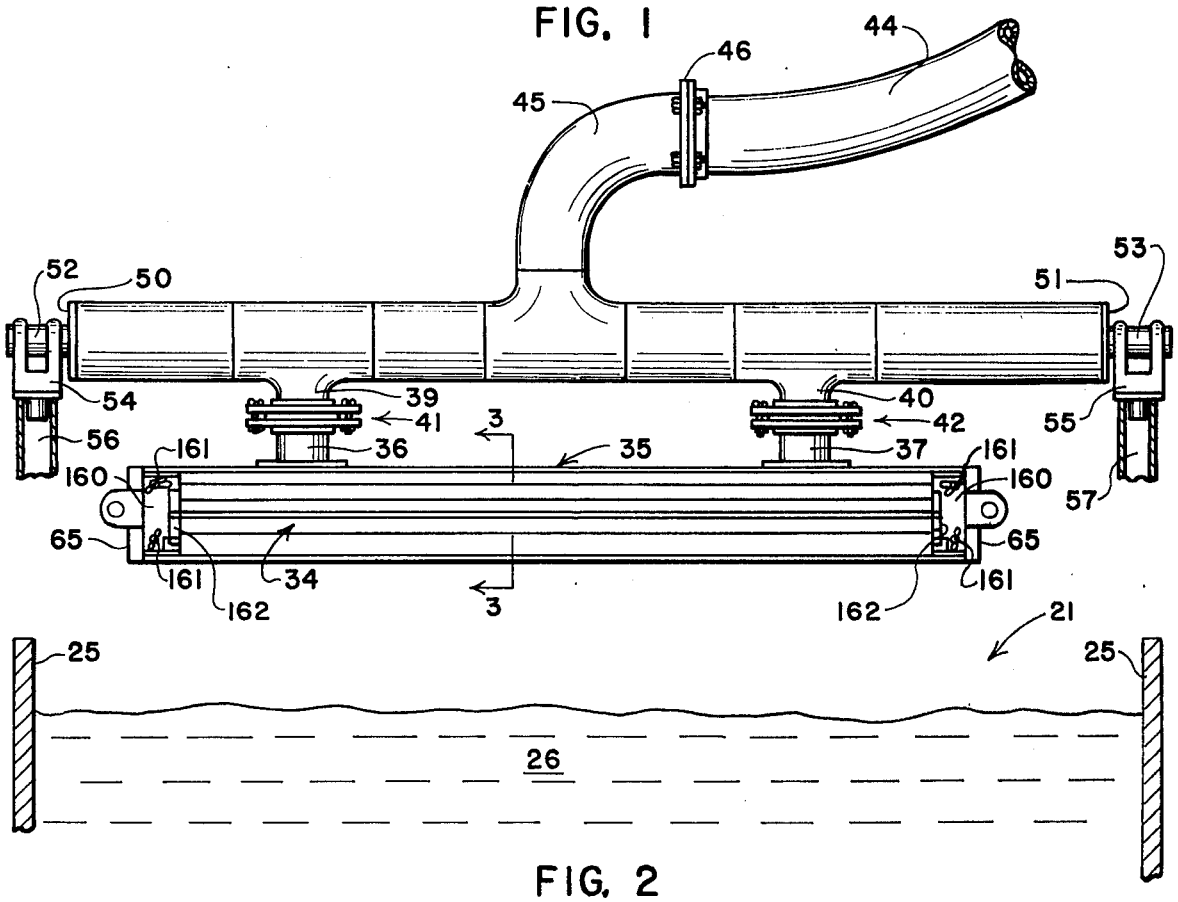
FIG. 2 is an enlarged elevational view of a portion of the apparatus as seen from a plane indicated by a line 2—2 in FIG. 1.

The coating control assemblies 30 are substantially identical in construction, one being reversed left to right from the other. Referring to FIG. 2, each of the coating control assemblies 30 includes an elongated nozzle assembly 34 supported on a housing assembly 35. A pair of fluid supply pipes 36, 37 extend upwardly from and support the housing assembly 35. A main supply pipe 38 has depending branch portions 39, 40 which extend toward the supply pipes 36, 37. Conventional coupling assemblies 41, 42 connect the supply pipes 36, 37 and the branch portions 39, 40 to support the housing assembly 35 on the main supply pipe 38. The supply pipes 36, 37 and the branch portions 39, 40 communicate to duct pressurized fluid into the housing assembly 35 from the main supply pipe 38.

Pressurized fluid is supplied to the main supply pipe 38 through a flexible conduit 44. An upstanding branch of the main supply pipe 38 includes an elbow 45. A conventional coupling assembly 46 connects and communicates the flexible conduit 44 and the elbow 45.

Opposite ends of the main supply pipes 38 are movably supported. Pairs of plates 50, 51 cap opposite ends of the main supply pipes 38. Pairs of stub shafts 52, 53 are welded to the plates 50, 51 and extend coaxially of the main supply pipes 38. Pairs of apertured yokes 54, 55 journal the stub shafts 52, 53 to pivotally mount the main supply pipes 38. Pairs of adjustable mounting assemblies, portions of which are indicated by the numerals 56, 57, support the yokes 54, 55 to control the position of the main supply pipes above the coating bath 21. By moving the yokes 54, 55 to selectively position the shafts 52, 53, the position of the coating control assemblies 30 is selectively adjusted.

Figure 3:
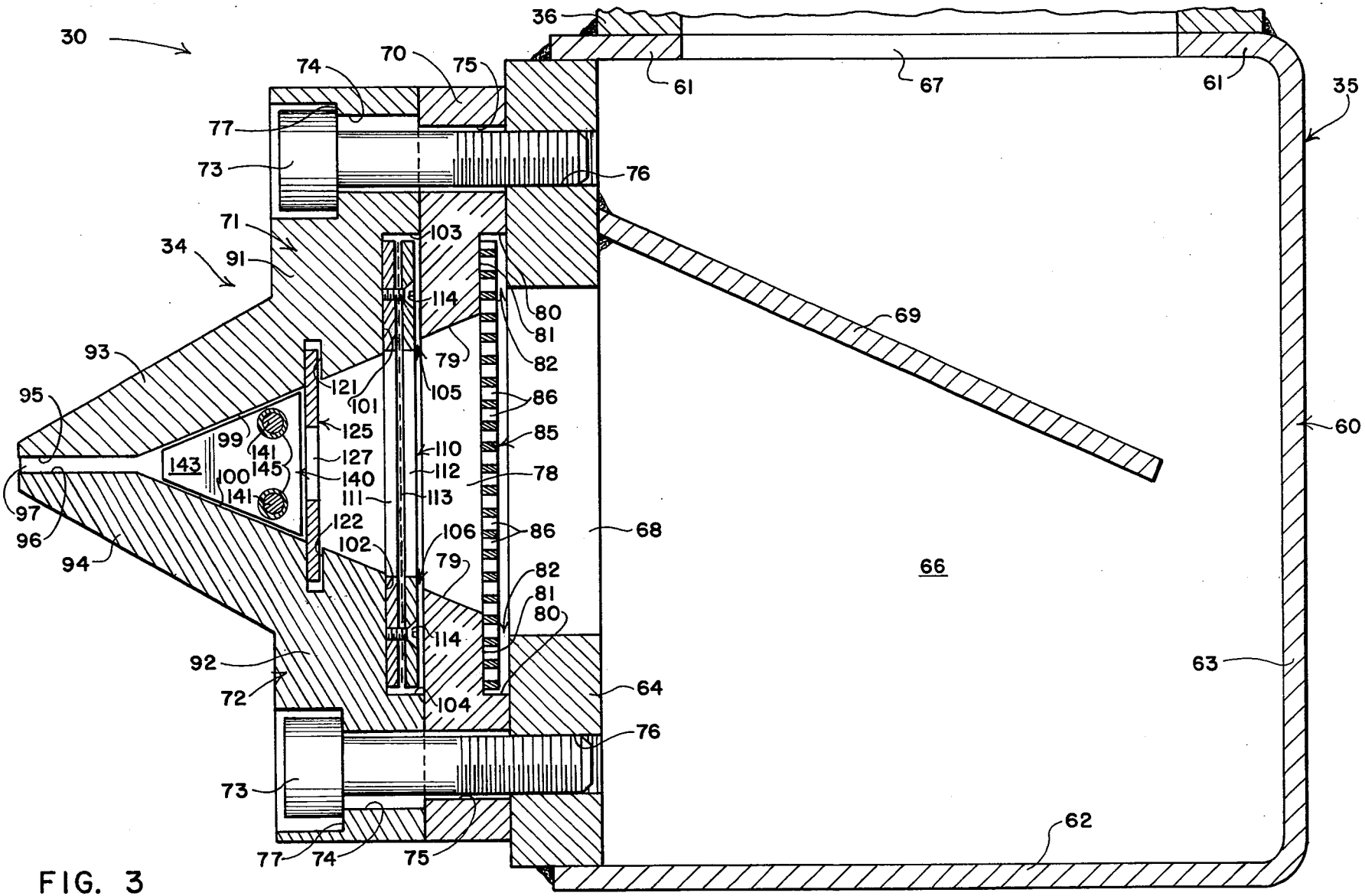
FIG. 3 is an enlarged sectional view of an air knife used in the apparatus of FIG. 1 as seen from a plane indicated by a line 3—3 in FIG. 2.

Referring to FIG. 3, each of the coating control housing assemblies 35 includes an elongated channel-shaped member 60 having top and bottom walls 61, 62 interconnected by a back wall 63. An elongated front plate 64 is welded to the top and bottom walls 61, 62. End plates 65, shown in FIG. 2, are welded to the ends of the front plate 64 and the channel-shaped member 60. The front plate 64, the channel-shaped member 60, and the end plates 65 cooperate to define an elongated chamber 66.

Pressurized fluid enters the chamber 66 through holes 67 formed in the top wall 61. The holes 67 communicate with the supply pipes 36, 37. Pressurized fluid exits the chamber 66 through an elongated slot 68 formed through the front plate 64. A flow diverter plate 69 is welded to the inner face of the front plate 64 and projects into the chamber 66. The flow diverter plate 69 diverts pressurized fluid entering the chamber 66 through the holes 67 and promotes its even distributir throughout the length of the chamber 66 before it discharges through the slot 68.

The nozzle assembly 34 includes an elongated spacer plate 70 and a pair of elongated "lips" 71, 72. Threaded cap screws 73 extend through aligned holes 74, 75 formed through the lips 71, 72 and through the spacer plate 70, and are threaded into aligned holes 76 formed in the front plate 64. The cap screws 73 have enlarged diameter heads which engage shoulders 77 formed in the holes 74. When the cap screws 73 are tightened in the threaded holes 76, they clamp the lips 71, 72, the spacer plate 70 and the front plate 64 together.

An elongated slot 78 is formed through the spacer plate 70. The slot 78 has forward wall portions 79 which taper to define a passage which converges as it approaches the forward face of the spacer plate 70. The slot 78 has rearward wall portions 80 which are relatively widely spaced. A vertically extending shoulder 81 joins the forward and rearward wall portions 79, 80.

The shoulder 81, the rearward wall portions 80, and the forward face of the front plate 64 cooperate to define elongated channels 82 which extend above and below the front plate slot 68. A baffle plate 85 is positioned in the channels 82 and extends across the front plate opening 68.

Figure 4:
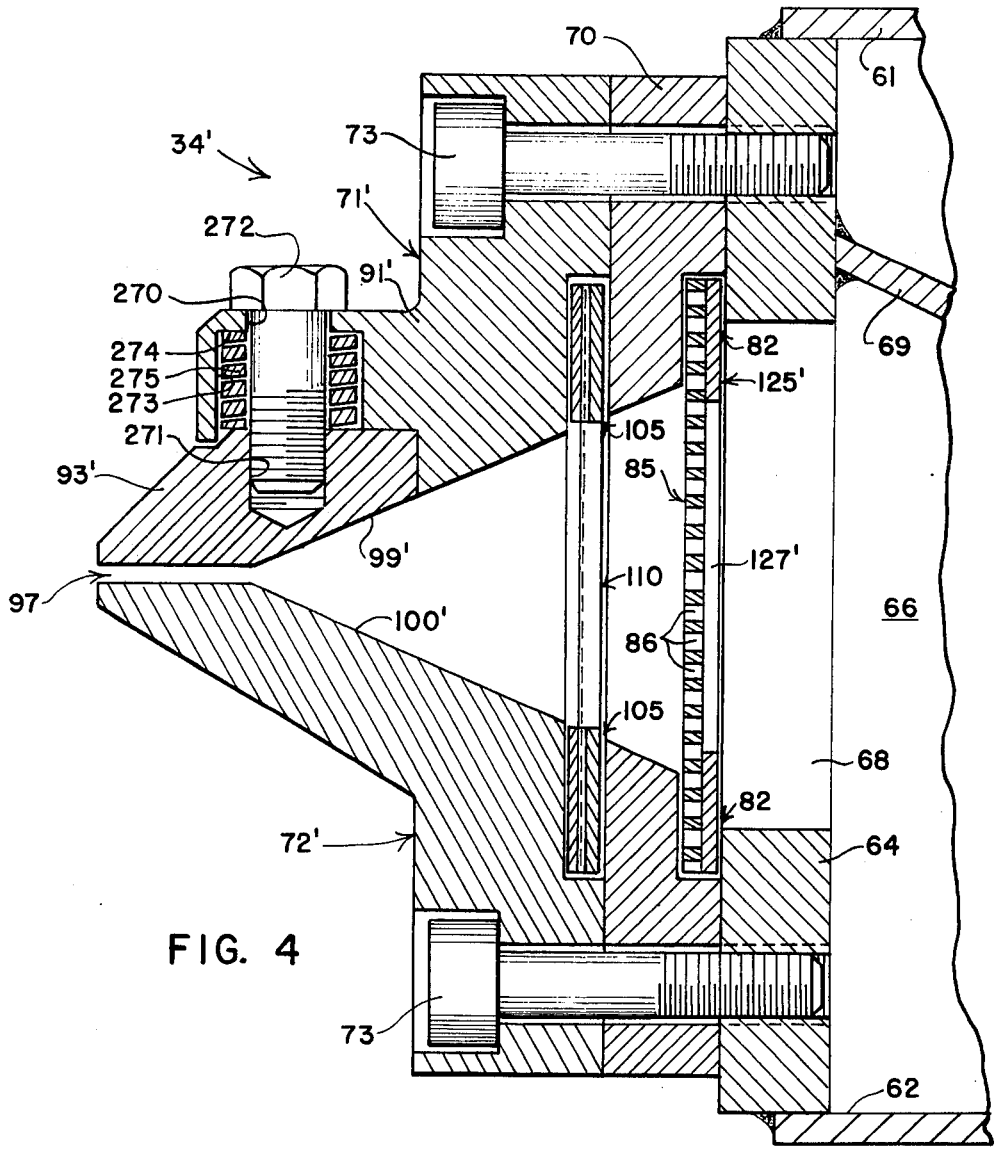
FIG. 4 is a sectional view similar to FIG. 3 of an alternate air knife embodiment.

Referring to FIGS. 4, 6 and 7, the baffle plate 85 is a perforated metal sheet provided with regularly spaced, uniform diameter holes 86 across its entire width and length. In preferred practice, the baffle plate 85 is formed from 11-gauge steel and has ⅛-inch holes arranged on 3/16-inch centers to give about a 40 percent open area that will help provide an equal pressure laminar flow through the baffle plate 85. One end region of the baffle 85 is bent at a right angle, as indicated by the numeral 87, to provide a handle that can be grasped to move the baffle 85 longitudinally in and out of position in the channels 82.

The lips 71, 72 are identical in construction and can be used interchangeably on top and bottom sides of the nozzle assembly 34. The lips 71, 72 have base portions 91, 92 and converging portions 93, 94.

The base portions 91, 92 carry the bolt holes 74 and have rear faces which are clamped against the spacer plate 70 by the cap screws 73. The bolt holes 74 loosely receive the cap screws 73 and permit the vertical positions of the lips 71, 72 to be adjusted within a limited range of movement.

The converging portions 93, 94 have forward inner wall portions 95, 96 which extend in spaced parallel relationship to define an elongated nozzle opening 97. The nozzle opening 97 is usually about 0.070 to 0.085 inches in width and may be adjusted to vary in width along its length if need be to facilitate the provision of an optimum pressure profile of discharging fluid. Adjoining the forward wall portions 95, 96 are intermediate wall portions 99, 100 which converge toward the nozzle opening 97. Vertically extending shoulders 101, 102 adjoin the converging wall portions 99, 100 and extend into the base portions 91, 92. Rearward wall portions 103, 104 intersect with the shoulders 101, 102 and open through the rear face of the lips 71, 72.

The shoulders 101, 102, the rearward wall portions 103, 104, and the front face of the spacer plate 70 cooperate to define a pair of elongated channels 105, 106 which extend above and below the spacer plate slot 78. A screen assembly 110 is positioned in the channels 105, 106 and extends across the spacer plate slot 78.

Referring to FIGS. 3, 8 and 9, the screen 110 assembly includes front and rear support plates 111, 112 which sandwich a metal screen 113. Truss head screws 114 extend through aligned holes formed in the rear plate 112 and in the screen 113, and are threaded into aligned holes formed in the front plate 111 to clamp the screen 113 between the plates 111, 112. In preferred practice, the screen 113 is formed from 100 mesh stainless steel wire cloth having a wire diameter f about 0.0045 inch which gives the screen 113 about a 30 percent open area. One end region of the rear plate 112 is bent at a right angle to the remainder of the plate 112, as indicated by the numeral 115, to form a handle. The handle 115 can be grasped to move the screen assembly 110 longitudinally in the channels 105, 106.

Vertically extending grooves 121, 122 are formed in the converging lip portions 93, 94 and open through the converging surfaces 99, 100. A shutter plate 125 is slidably carried in the grooves 121, 122 and extends across the converging passage formed between the surfaces 99, 100.

Figure 10:
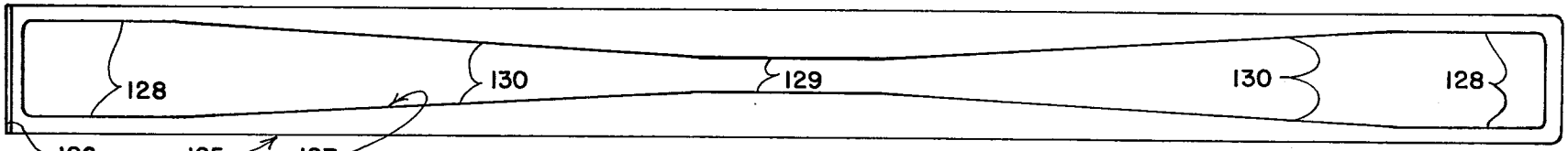
FIGS. 10–14 are side elevational views of alternate shutter embodiments used in the air knives of FIGS. 3 and 4.

Referring to FIGS. 3 and 10, the shutter plate 125 is formed from a metal sheet and has one end region bent at a right angle to the remainder of the plate to form a handle 126. An opening 127 is formed through the shutter 127.

The shutter opening 127 has an hour-glass shape which varies in width along the length of the shutter plate 125. In the embodiment of FIG. 10, the shutter opening 127 has a length of about 60 inches. End regions of the opening 127, indicated by the numerals 128, extend for a distance of about 6 inches at a uniform width of about 3 inches. A central region of the opening 127, indicated by the numeral 129 extends for a distance of about 8 inches at a uniform width of about 1 inch. Intermediate regions of the opening 127, indicated by the numerals 130, have straight sides which taper to smoothly connect the end and central regions 128, 129.

The profile of the shutter opening 127 is configured to assure that the pressurized fluid which discharges through the nozzle opening 97 has a predetermined profile which differs from location to location along the length of the nozzle assembly 34. The centrally constricted configuration of the nozzle opening 127 provides a pressure profile having its highest pressures near opposite ends of the nozzle assembly 34, and its lowest pressures near the center of the nozzle assembly 34. At locations between the ends and the center of the nozzle assembly 34, the pressure of discharging fluid progressively changes to provide a smooth transition between the end and central pressures.

By controlling the pressure profile of fluid discharging from the coating control assemblies 30, a corresponding controlled coating profile is obtained on a substrate 20. Lower fluid discharge pressures permit a thicker coating to be retained on the substrate 20, while higher fluid discharge pressures screed more coating material from the substrate leaving a thinner coating deposit. When shutters such as are shown in FIG. 10 are used in the fluid control assemblies 30, they will leave a convex coating profile on the substrate 20, i.e., the coating will be thicker toward central regions of the substrate than in peripheral regions near edges of the substrate.

Figure 11:
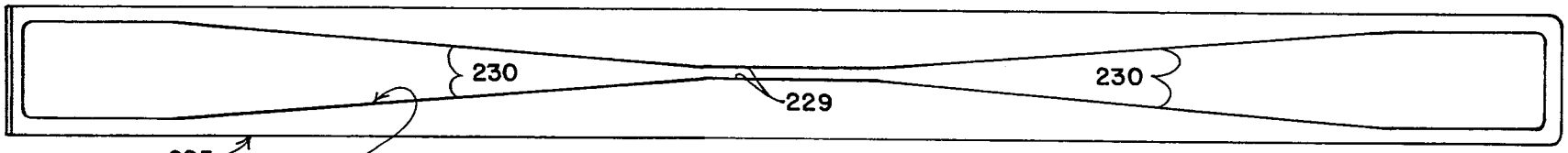
Figure 12:
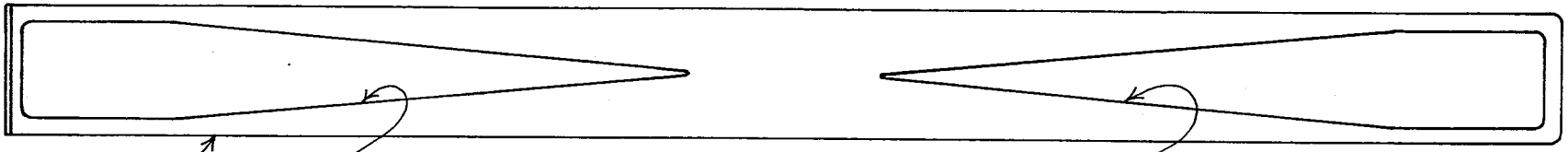

Referring to FIGS. 11 and 12, shutter plates 225, 325 having differently configured shutter openings 227, 327 can be used in the control assemblies 30 to obtain somewhat differing coating profiles. The opening 227 differs from the opening 127 in that the central portions 229 are more closely spaced than are the central portions 129, and the tapered portions 230 converge more rapidly to accommodate the more closely spaced central portions 229. The openings 327 differ from the openings 127, 227 in that the distance between the center portions is reduced to zero, whereby two separate openings result. Each of the shutter plates 225, 325 will provide a convex coating profile on the substrate 20.

Figure 15:
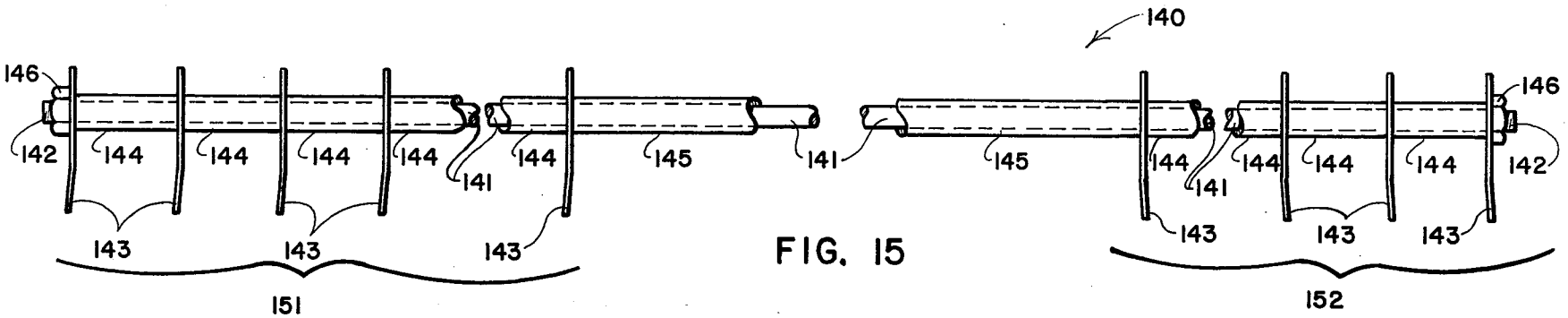
FIG. 15 is a top plan view of a vane assembly used in the air knife embodiment of FIG. 3.

Referring again to FIG. 3, a vane assembly 140 is positioned between the converging surfaces 99, 100 at a location leftwardly or downstream from the shutter plate 125. Referring to FIGS. 3 and 15, the vane assembly 140 includes a pair of mounting rods 141. Threaded end regions 142 are formed on the rods 141. An array of vanes 143, short spacers 144, and long spacers 145 are carried on the mounting rods 141. Nuts 146 are threaded onto the end regions 142 and clamp the assembly of vanes and spacers.

Figure 16:
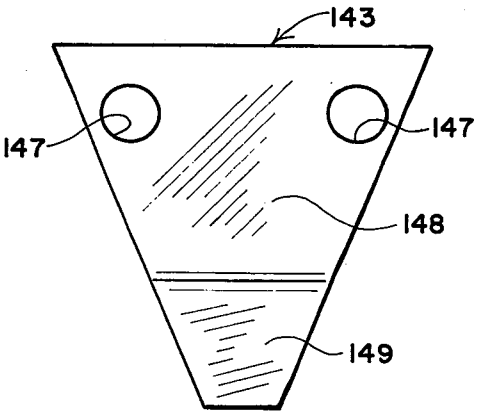
FIG. 16 is an enlarged side elevational view of one of the vanes used in the assembly of FIG. 15; and, FIG. 17 is an end elevational view of the vane of FIG. 16.
Figure 17:
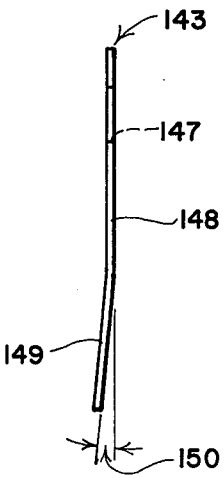

Referring to FIGS. 16 and 17, the vanes 143 are formed from sheet metal of about 22 gauge and have a substantially trapezoidal shape. Two holes 147 are formed through each vane 143 to receive the mounting rods 141. Each vane 143 has a base portion 148 which, when assembled as shown in FIG. 15, extends substantially perpendicular to the axes of the mounting rods 141. In the best mode known for practicing the present invention, each vane 143 additionally has a distal portion 149 which is inclined at an angle relative to the plane of its associated base portion 148, as indicated by the numeral 150 in FIG. 17. The preferred magnitude of the angle 150 is 5°.

Referring again to FIG. 15, the vanes 143 are arranged in two groups 151, 152 near opposite ends of the assembly 140. Where the assembly 140 has a length of about 60 inches, each of the groups of vanes 151, 152 preferably includes 29 of the vanes 143. The short spacers 144 which separate the vanes within each of the groups 151, 152 preferably have a length which will space the vanes in each group at about ¾ inch on center. The long spacers 145 which extend between the vane groups 151, 152 have lengths of about 16 inches with only one of these long spacers being used on each of the mounting rods 141.

The vanes 143 in each of the groups have their distal portions 149 facing away from the long spacers 145 toward opposite ends of the vane assembly 140. The slight 5° inclination of the distal portions 149 serves to add a small longitudinal vector to the direction of fluid discharging from end regions of the nozzle assembly 34. This small longitudinal vector provides a substantial improvement in substrate coating distribution in that it effectively prevents the formation of coating build-up along peripheral portions or edges of the substrate 20. Such "spooling" as can result during cooling of the substrate where a coating build-up occurs along peripheral portions or edges is obviated by the operation of the vane assembly 140.

Referring again to FIG. 2, a pair of access doors 160 are provided at opposite ends of the nozzle assembly 23 to provide ready access to the baffle plate 85, the screen assembly 110, the shutter plate 125, and the vane assembly 140. The access doors 160 are held in place on the front plate 64 by wing-head bolts 161 which extend through holes in the doors 160 and are threaded into holes in the front plate 64. The doors 160 carry nozzle end plates 162 which extend across and cover the ends of the spacer plate 70 and the lips 71, 72. When one of the access doors 160 is removed, the handles 87, 115 and 126 formed on the baffle 85, the screen assembly 110 and the shutter plate 125 can be grasped to facilitate the removal, cleaning and replacement of these components. The vane assembly 140 can also be easily grasped for removal once the shutter plate 125 has been removed from the nozzle assembly 34.

Referring to FIG. 4, an alternate nozzle assembly embodiment 34' is illustrated. The nozzle assembly has many of the same components used in nozzle assembly 34, and the same reference numerals are used on these parts as appear in FIG. 3. Other components have a similar function to components shown in FIG. 3 and are indicated in FIG. 4 by corresponding primed reference numerals.

There are three principal differences between the nozzle assemblies 34, 34'. First, in the nozzle assembly 34' a multipart adjustable lip assembly 71' is used in place of the single piece lip 71. Second, in the nozzle assembly 34', a shutter plate 125' is mounted adjacent the baffle plate 85 in the channels 88 instead of being positioned downstream from both the baffle plate 85 and the screen assembly 110 in spacially provided grooves 121, 122. Third, no vane assembly 140 is used in the embodiment of FIG. 4. All three of these differences make the embodiment of FIG. 4 less preferred than the embodiment of FIG. 3.

Referring to FIG. 4, the multipart lip assembly 91 includes a base member 91' and a converging member 93'. Aligned holes 270, 271 are formed in the members 91', 93'. Cap screws 272 extend through the holes 270 and are threaded into the holes 271 to connect the members 91', 93'. Enlarged diameter, downwardly opening bores 273 are provided in the base member 91' below the holes 270. Horizontally extending shoulders 274 adjoin the bore 273 and the holes 270.

Compression coil springs 275 are positioned in the bores 273 and surround the stems of the cap screws 272. The upper ends of the springs 275 engage the shoulders 274. The lower ends of the springs 275 engage the upper face of the converging member 93'. The springs 275 bias the converging member 93' downwardly away from the base member 91', and operate to move the converging member 93' downwardly when the set screws 272 are loosened. When the set screws 272 are tightened, the biasing action of the springs 275 must be overcome in moving the converging member 93' upwardly.

The purpose of providing a multipart lip assembly 71 is to permit facile adjustment of the width of the nozzle opening 97. Such a provision is undesirable from the viewpoint of its added fabrication expense. The embodiment of FIG. 3 with its shutter plate 125 located closer to the nozzle opening 97 and with its vane assembly 140 has been found to obviate the need for an adjustable lip assembly 71' to obtain desired pressure profiles in the fluid discharging from the opening 97.

Figure 13:
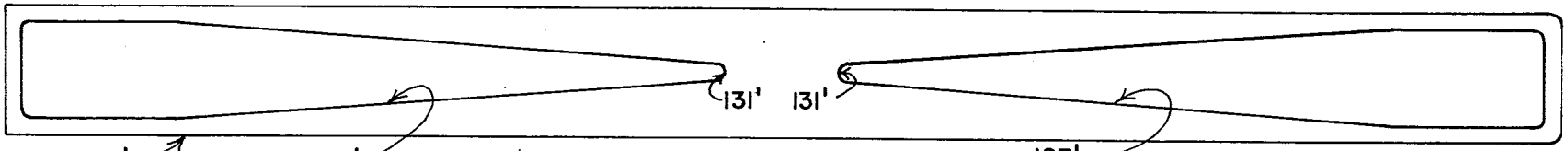
Figure 14:
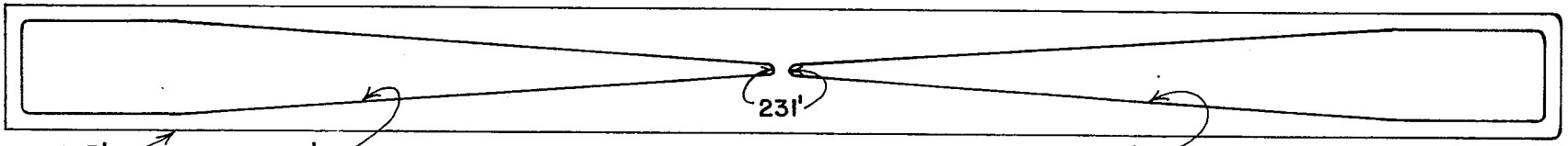

Referring to FIG. 13, the shutter plate 125' has a pair of tapered openings 127' which converge toward each other and terminate in spaced rounded end formations 131'. A similar, alternate shutter plate 225' is shown in FIG. 14 and has openings 227' which terminate in more closely spaced rounded end formations 231'. Either of the shutter plates 125', 225' will operate to provide a convex coating profile on the substrate 20.

While all of the shutter plates shown in FIGS. 10–14 are designed to give various types of convex coating profiles, this is not to say that the present invention is limited in its applicability to the formation of convex coating profiles. Shutters having constant width openings can be used to provide substantially uniform thickness coating profiles. Shutters having openings which are wider in central regions and converge toward end regions can be used to provide concave coating profiles. Shutters having openings which do not extend the full length of the shutters can be used where substrates which are narrower than the length of the nozzle assemblies 34 are to be coated.

Figure 5:
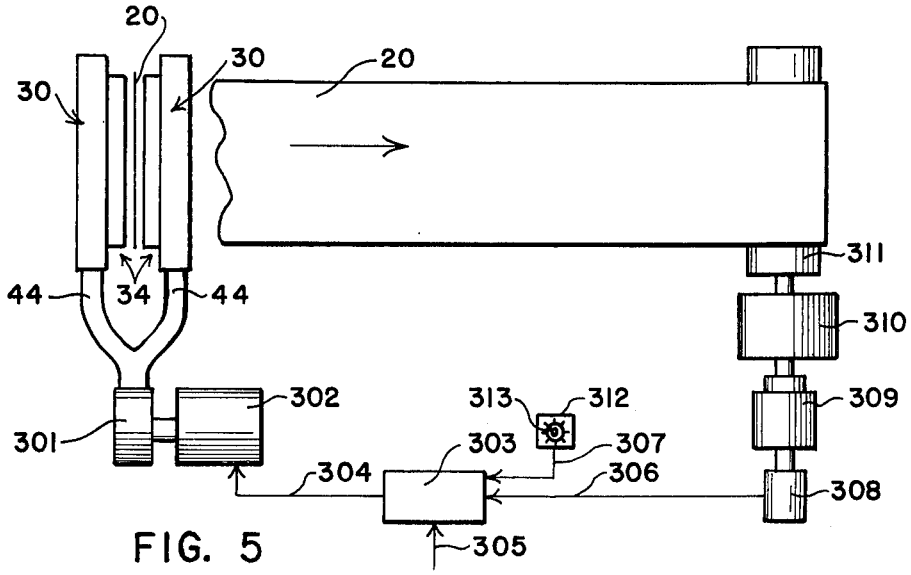
FIG. 5 is a schematic drawing of a system for supplying pressurized fluid to the air knives of the apparatus of FIG. 1.

Referring to FIG. 5, a system for supplying pressurized fluid to the coating control assemblies 30 is shown schematically as including a blower 301 which supplies pressurized air to the flexible conduits 44. A direct current motor 302 drives the blower 301. Direct current is supplied to the motor 302 from a motor control 303, as indicated by an arrow 304. Direct current is supplied to the motor control 303 from a source of current, as indicated by an arrow 305.

The motor control 303 is a commercially available device which controls the mgnitude of voltage supplied to the blower drive motor 302 in accordance with two input signals indicated by the numerals 306, 307.

The input signal 306 is provided by a tachometer sensor 308. The tachometer sensor 308 is connected to the output shaft of a motor 309. The motor 309 is a variable speed motor, the output shaft of which is coupled through a gear reducer 310 to a line roll 311. The line roll 311 engages the substrate 20 and moves the substrate 20 at a speed which is proportional to the speed of operation of the motor 309. By this arrangement, the output signal from the tachometer sensor 308 is representative of the line speed of the moving substrate 20.

The input signal 307 is provided by a manually adustable control 312. The control 312 includes a knob 313 which can be set at positions representative of any of a series of desired coating thicknesses. The input signal 307 provided by the manual control 312 has a magnitude which is representative of the desired coating thickness for which the knob 313 is set.

The motor control 303 operates to change the supply of voltage to the blower motor 302 to adjust blower speed in response to a sensed change in line speed. Where line speed changes from an initial roll rotation speed of $V_1$ revolutions per minute to a new speed of $V_2$ revolutions per minute, the required new blower output pressure $P_2$ is expressed by the following equation as a function of the initial blower output pressure $P_1$:

$$P_2 = P_1 (V_1/V_2)^2$$

Expressed in another way, the motor control 303 operates to increase the supply of current to the blower motor 302 to increase the speed of operation of the blower 301 when the tachometer 308 senses an increase in line speed. The need to increase blower speed when line speed increases is due to the fact that the flow rate of fluid discharged from the nozzle assemblies 34 must be increased with increased line speed to maintain a constant coating thickness. Similarly, the motor control 303 operates to decrease blower speed with decreasing line speed to maintain a constant coating thickness.

The coating thickness maintained by the motor control 303 is dependent on the magnitude of the input signal 307 from the manual control 312. The static pressure of fluid supplied by the blower 301 to the coating control assemblies 3 is within the range of about 0 to 4 psig and is accurately maintained at a predetermined pressure within this range by controlling the speed of operation of the blower 301.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. An apparatus for screeding excess coating material from a substrate as the substrate moves along a feed path, comprising:

a. a nozzle positioned near the feed path and defining an elongated discharge opening oriented toward the feed path;

b. a conduit defining a passage of elongated cross-section extending substantially the full length of and communicating with the discharge opening for supplying pressurized fluid to and discharging pressurized fluid through the discharge opening toward the feed path;

c. flow regulating means for selectively regulating the rate of flow of fluid through portions of the conduit such that fluid discharging toward the feed path from the discharge opening has a predetermined nonuniform pressure profile along the length of the discharge opening that will cause all but a desired cross-sectional profile of coating material to be screeded from a substrate moving along the feed path past the nozzle, said flow regulating means including a shutter structure comprising an elongated member positionable across the conduit passage, said elongated member including at least one elongated opening which varies in width along its length, said opening defining a flow regulating formation for restricting fluid flow through the conduit passage, to a greater degree in some conduit portions than in other conduit portions; and d. vane means positioned downstream from the flow regulating means and in the conduit passage for guiding fluid which passes through the flow regulating means for discharge through the discharge opening, said vane means including a plurality of vanes arranged in a longitudinally spaced array near selected portions of the discharge opening, each vane including a base portion and a distal portion, said base portion being substantially aligned with the direction of flow of pressurized fluid toward the substrate, said distal portion extending laterally from the downstream end of said base portion toward the direction of the substrate edge to which it is closer.

2. The apparatus of claim 1, wherein said vane distal portion is oriented at an angle of approximately 5° to the flow direction of the pressurized fluid.

3. An apparatus for controlling the profile of coating material deposited on a substrate by discharging fluid having a controlled pressure profile toward the substrate as it emerges from a coating station, comprising:

a. structure positioned near a coating station and defining a plenum chamber substantially paralleling a coated surface on a substrate emerging from the coating station;

b. pressurized fluid supply means connected to the structure for supplying pressurized fluid to the plenum chamber, said pressurized fluid supply means including a variable output pump, sensor means for sensing the speed of movement of the substrate, and control means for controlling the output of the pump in response to sensed substrate speed with pump discharge pressure being increased to increase the pressure of fluid supplied to the plenum chamber in response to a sensed increase in substrate speed, and with pump discharge pressure being decreased to decrease the pressure of fluid supplied to the plenum chamber in response to a sensed decrease in substrate speed;

c. nozzle structure defining an elongated discharge opening facing toward and substantially paralleling such coated surface for discharging pressurized fluid toward such coated surface; and, d. fluid pressure profile control means communicating the plenum chamber and the discharge opening for ducting pressurized fluid from the plenum chamber through the discharge opening and for conforming the pressure profile of fluid emanating from the discharge opening to any one of a plurality of predetermined pressure profiles, the profile control means including structure defining a conduit having an elongated cross-section and communicating the plenum chamber and the discharge opening;

e. flow control means in said conduit for restricting fluid flow through some portions of said conduit to a greater degree than through other portions of said conduit;

f. a plurality of vanes positioned in said conduit downstream from the flow control means for directing fluid along flow baths defined by the vanes and through the nozzle opening;

g. structure interconnecting said vanes and facilitating their positioning in said conduit as an assembly; and h. a portion of said conduit is removable to provide access to said flow control means and said interconnected vanes.

* * * * *

UNITED STATES PATENT OFFICE

CERTIFICATE OF CORRECTION

Patent No. 4,041,895 Dated August 16, 1977

Inventor(s) Overton, H. V. et al

It is certified that error appears in the above-identified patent and that said Letters Patent are hereby corrected as shown below:

Col. 13, Line 20, change "mgnitude" to -- magnitude --

Col. 13, Line 50, change "$P_2=P_1(V_1/V_2)^2$" to

-- $P_2=P_1(V_2/V_1)^2$ --

Col. 13, Line 53, change "current" to -- voltage --

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*